United States Patent [19]

Nishibu et al.

[11] 4,444,858

[45] Apr. 24, 1984

[54] METHOD OF PREPARING A LITHOGRAPHIC PRINTING PLATE

[75] Inventors: Satoshi Nishibu, Tokyo; Yasusuke Takahashi, Funabashi; Gentaro Nagamatsu; Toshibumi Sakata, both of Tokyo, all of Japan

[73] Assignees: Fuji Chemicals Industrial Co., Ltd., Tokyo; Tokai University, Shibuya, both of Japan

[21] Appl. No.: 201,036

[22] Filed: Oct. 27, 1980

Related U.S. Application Data

[63] Continuation-in-part of Ser. No. 24,971, Mar. 29, 1979, abandoned.

[30] Foreign Application Priority Data

May 1, 1978 [JP] Japan ..... 53-52586

[51] Int. Cl.[3] ..... G03G 13/28

[52] U.S. Cl. ..... 430/49; 101/465; 427/14.1

[58] Field of Search ..... 101/465, 466, 467; 430/49; 427/259, 14.1

[56] References Cited

U.S. PATENT DOCUMENTS

| | | | |
|---|---|---|---|
| 3,063,859 | 11/1962 | Heckscher | 427/22 |
| 3,071,070 | 1/1963 | Matthews et al. | 101/149.2 |
| 3,315,600 | 4/1967 | Tomanek | 101/149.2 |
| 3,647,499 | 3/1972 | Colt et al. | 96/1.4 X |
| 3,860,436 | 1/1975 | Meagher | 96/1.4 X |

FOREIGN PATENT DOCUMENTS

| | | | |
|---|---|---|---|
| 756595 | 3/1971 | Belgium | 430/49 |

*Primary Examiner*—Evan K. Lawrence
*Attorney, Agent, or Firm*—Quaintance & Murphy

[57] ABSTRACT

A method of preparing a lithographic printing plate in which a toner image formed by electrophotographic process is transferred and fixed on a metal base lithographic printing plate having a thin insulating synthetic resin surface layer. Thereafter the synthetic resin layer on the non-image area is removed followed by removal of the toner to leave resin image areas.

10 Claims, 8 Drawing Figures

METHOD OF PREPARING A LITHOGRAPHIC PRINTING PLATE

This is a continuation-in-part application of application Ser. No. 024,971, filed Mar. 29, 1979, abandoned.

BACKGROUND OF THE INVENTION

The present invention relates to a method of manufacturing a lithographic printing plate by electrophotographic process.

In conventional lithographic printing, a plate coated with a photosensitive resin is mainly used. This resin is sensitive to ultraviolet rays (of less than 450 nm). This sensitivity is extremely low as compared with that of silver halide photosensitive material, or photoconductive materials now used for electrophotography. Therefore, in conventional photographic printing plate making system, a negative original film is firstly prepared with a silver halide lith film, and then the original film is contacted on a lithographic printing plate in a vacuum printer. They are exposed by the ultraviolet rays and the lithographic printing plate can be prepared by this contact print process.

Recently, a new plate making method which is claimed to be the printing plate making process with the camera exposure speed has been developed, in which the using of the photographic lith film is excluded for the purpose of saving labor and resources, and preventing environmental pollution.

Several methods of making a printing plate by electrophotographic process are already known, and many proposals have been made for its use to form the lithographic printing plate. For instance, there is known an electrophotographic method utilizing a zinc oxide photoconductive layer. According to this method, a toner image is formed on a zinc oxide photoconductive layer coated on a sheet of paper or aluminum; the area of the toner image has oleophilic properties; and the zinc oxide photoconductive layer of the non-image area is treated to have hydrophilic properties, thereby providing a lithographic printing plate. The plate thus obtained meets the requirements of cost, speed of making and environmental conservation, but it is far inferior in durability to the pre-sensitized plate (PS plate) utilizing the conventional photosensitive resin, Accordingly, it is useful only for shortrun printing in what is called "light printing" or "office printing".

Lately commercial printing and newspaper printing by electrophotographic process has been announced, such as the "PYROFAX" system of 3M Co. (Minnesota Mining and Manufacturing Co.) or "ELFASOL" system of Kalle AG. 3M's "PYROFAX" is so-called "a magne-dry system" with inferior resolution due to coarse grains of toner and is low durability and complicated handling. Kalle's "ELFASOL" is non-transfer type imaging system using an aluminum plate coated with an organic photoconductor which has the merit of no deterioration of toner image during transfer, but has the defects of requiring the photoconductive layer to be considerably over 5μ thick to hold the electric charge for having both properties of electrophotographic performance and mechanic strength in printing.

Many other methods of making a printing plate by electrophotographic process have been proposed. For instance, U.S. Pat. Nos. 3,071,070 and 3,063,859 disclose a method of transferring a toner image directly onto a metal plate for printing to make a lithographic printing plate. In these methods the transfer effect is poor quality with a so-called "hollow" image, and the image reproducibility is unsatisfactory, because of direct transfer onto an electroconductive base plate. The U.S. Pat. No. 3,647,499 discloses a method of transferring, with a thin layer of insulating liquid inserted between the metal plate and the photoconductive substrate. This method had the defects of a liquid being used for transfer and the toner being dispersed in the liquid. Meanwhile published Japanese patent application Nos. Sho 50-1801, 51-129302 and 51-143408 disclose double exposure methods, i.e., image exposure by electrophotographic process and total post-exposure by ultraviolet rays with use of the conventional PS plate or photosensitive relief plate for the purpose of assuring high durability; but this method is deprived of the desirable feature of electrophotographic process that requires exposure only to visible light.

SUMMARY OF THE INVENTION

After strenuous efforts to eliminate the above drawbacks in the conventional methods, applicants have discovered that a lithographic printing plate with high durability can be obtained, if a metal printing plate imparted with high photosensitivity by electrophotographic process and coated with a synthetic resin layer is employed as the transfer acceptor and said synthetic resin layer is imparted with durability and toner transferability.

A first object of the present invention is to provide a method of preparing a lithographic printing plate which is rendered fast and cheap through omission of the conventional process of making a silver halide lith film.

A second object of the present invention is to provide a method of preparing a lithographic printing plate with high durability.

A third object of the present invention is to provide a method of preparing a lithographic printing plate using ordinary visible light, thus permitting exposure through a lens system or by light scanning.

Other objects and many of the attendant advantages of this invention will be readily appreciated as the same becomes better understood by reference to the following detailed description when considered in connection with the accompanying drawings, in which like reference characters designate the same or similar parts throughout the figures thereof.

BRIEF DESCRIPTION OF THE ATTACHED DRAWINGS

DETAILED DESCRIPTION OF THE INVENTION

The invented method of preparing a lithographic printing plate is characterized in that a toner image formed on a photosensitive sheet by electrophotographic process is transferred and fixed on a metal printing plate preliminarily coated with a 0.5 to 10μ thick electrically insulating, durable synthetic resin layer (hereafter referred to as a transfer printing plate); and the difference in solubility to a solvent between the toner resin and the synthetic resin on the transfer printing plate is utilized to remove the non-image area through dissolution while the toner image acts as an insoluble resist.

The basic steps in the invented method of plate making are:

(1) Totally charging the photosensitive sheet;

(2) Forming an electrostatic latent image by projecting an image of the original copy through an optical system onto the photo sensitive sheet obtained in Step (1);

(3) Developing the electrostatic latent image with a toner;

(4) Transferring a toner image thus obtained onto a metal printing plate previously coated with a synthetic resin layer;

(5) Fixing the toner image thus transferred; and (6) Removing the non-image area of the synthetic resin layer, which is not covered by the fixed toner image.

If desired, the toner layer can be removed after the removing process of (6), to expose the toner protected areas of synthetic resin layer on the transfer printing plate, to make the printing plate.

Now the details of these basic steps will be described with reference to the drawings.

Figure 1:
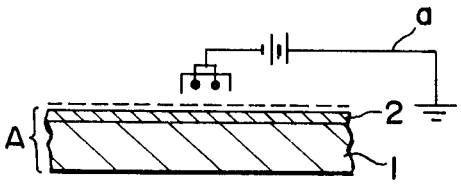
FIG. 1 is an enlarged view in section schematically showing the process of totally charging on the photoconductive layer.
Figure 2:
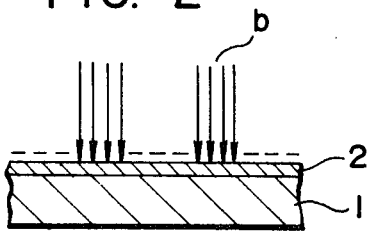
FIG. 2 shows the process of forming an electrostatic latent image on the photoconductive layer of FIG. 1.

First, an electrophotosensitive sheet A, which is a base sheet 1 having a laminated photosensitive coat in the form of a photoconductive layer 2, is totally charged by means of a corona-charging device a (FIG. 1). Next, light b reflected from a positive reflection copy through an optical system is projected onto this photosensitive sheet A. Then on sheet A, which is a photoconductor, the radiated or illuminated areas become electroconductive and lose the charge, thereby leaving an electrostatic latent image on the non-radiated areas (FIG. 2).

As the original, matters which can be directly printed are used such as: phototypesetting letter print, positive screen photoprint, paste-up, proof print, and printed matter. As the light source to illuminate the original the following are available; tungsten lamp, fluorescent lamp, halogen lamp, xenon lamp, etc.

In this case if the number of mirrors used is zero or even, the image on the plate will be normal, preparing an offset plate-making; and if it is odd, the image will be reversed, preparing a direct-lithographic plate-making. It goes without saying that a lens can be employed for enlargement, reduction, and/or variable-dimension reduction. There are other methods of image exposure such as: projection exposure with use of microfilm as the original copy; and scanning of a photosensitive sheet with a laser beam emitted from a machine edited by a computer to yield an electrostatic latent image. It goes without saying that direct connection to a facsimile device makes it possible to make a printing plate at a remote location. For this purpose, low-output rays in the visible range are available such as helium-neon (632.8 nm), argon (514.5, 488 nm), and helium-cadmium (441.6 nm). Photoconductors available include: selenium group, zinc oxide group, organic photoconductor (OPC) group, cadmium sulfide group, etc., well-known in electrophotography; but for the purpose of transfer to a metal plate which is harder than paper, zinc oxide or OPC which is flexible is preferable.

Next, the electrostatic latent image thus obtained is developed as a toner image 3 (FIG. 3) by any of the various known electrophotographic developing methods, for instance, the magnet brush method, the cascade method, the powder cloud method, the fur brush method, etc. The toner used for development is required to have higher insolubility and higher resolution than the conventional copying toner; therefore one with a particle size of less than 10μ, preferably about 5μ is used. The resins available as binders of the toner include: polystyrene, styrene and acrylonitril copolymer, polyethylene, polypropylene, acryl resin, fluoro resin, vinyl resin, epoxy resin, and cumaron resin, the resin or resins used depending on the kind of synthetic resin on the transfer printing plate, and the property of the solvent used to remove it. The toner need not be black; it can be any color or even clolorless and transparent.

Figure 3:
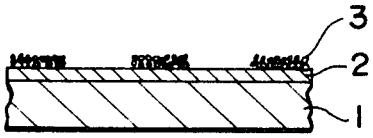
FIG. 3 shows the photoconductive layer with its electrostatic latent image developed with a toner.
Figure 4:
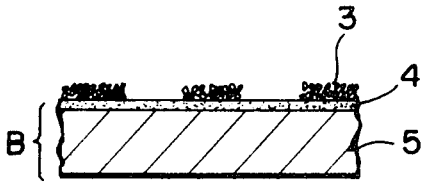
FIG. 4 is an enlarged view in section of a transfer printing plate with a toner image transferred thereon from the photoconductive layer of FIG. 3.

Next, the toner image formed on the photosensitive sheet in FIG. 3 is transferred under pressure and in an electric field by being closely contacted with the transfer printing plate B, which consists of a metal base plate 5 coated with a synthetic resin layer 4 (FIG. 4). When the transfer is made by the corona transfer process which is usually used in the conventional plain paper copier (PPC), undesirable phenomena occur such as uneven transfer, and decline in resolution.

For the transfer process in this invention, what is called the bias roll method is found the best, in which the transfer is made under application of voltage and pressure, using an electroconductive roller. In this method, the electroconductive roller may be used to apply both a voltage and a pressure, or an ordinary rubber roller may be used to apply a pressure and at the same time apply a voltage between the photosensitive sheet and the metal printing plate with a synthetic resin layer. The electroconductive roller mentioned here refers to a metallic roller or an electroconductive rubber roller. In the case of a metallic roller being used, the applied voltage depends on the resistance between the photosensitive sheet and the transfer printing plate. When the photosensitive sheet and the object of transfer are the same, a low voltage results in a poor transfer efficiency, but too high a voltage causes a short-circuit, which disturbs the image. Meanwhile too high pressure applied will disturb or collapse the transferred image, while too low pressure applied will cause uneven transfer. Such a method of transferring an image onto a metal plate is disclosed, for instance by the U.S. Pat. No. 3,063,859. Thus direct transfer onto a metal plate will not provide satisfactory transfer efficiency and a good quality of image on account of an exchange in the charge between the charged toner particles and the metal plate (electrode).

When, however, the metal plate is thinly coated with synthetic resin according to the present invention, the synthetic resin coat acts as a blocking electrode and thereby the charged toner particles can be efficiently transferred onto the transfer printing plate in an electric field to form an image. In this case however, when synthetic resin having a low insulation is used, the obtained layer does not act as a blocking electrode, whereby the transfer efficiency of the toner image is on the same level as that obtained by a direct transfer of the toner image onto a printing metal plate. The materials available as the transfer printing plate are: an aluminum plate, a zinc plate, a bimetal plate, a tri-metal plate, which are popularly used; but the most suitable ones are grained aluminum plate or one treated by an anodizing.

As a synthetic resin to be used for coating layer 4 of the present invention, the following are found appropriate from the standpoints of durability, insulation, adhesiveness to the toner and solubility to the solvent and they can be used singly or combined, or selectively depending on the composition of the toner-binding resin or the solvent: phenol resin, epoxy resin, polystyrene resin, vinyl resin, polyurethane resin, melamine resin, polyester resin, acrylic resin, polyamide resin, cumaron resin, phenoxy resin. Meanwhile, a dyestuff, a pigment to color it, a plasticizer, etc. may be contained in the synthetic resin coat 4. Said synthetic resin coat on the transfer printing plate is in the range of about 0.5 to 10$\mu$ thick, or preferably in the range of 0.5–3$\mu$ thick for improved transferrability and printing.

When the thickness of the synthetic resin coat exceeds 10$\mu$, transfer becomes difficult due to low voltage thereon, while it is not favorable that the synthetic resin coat shows no insulating effect with its thickness of smaller than 0.5$\mu$.

Figure 5:
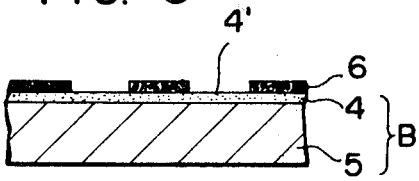
FIG. 5 is an enlarged view in section of the transfer printing plate with the toner image fixed thereon.

Next, the toner image formed on the plate B in the process of FIG. 4 is fixed, yielding a fixed toner image 6 (FIG. 5). Fixing may be done by any well-known method: heat radiant method, hot plate method, hot roller method or solvent vapor method. In this process it is important that the toner image is fully fixed so that it can resist the solvent used to removing.

Next comes the step of removing the non-image area 4' (FIG. 5), i.e. the area of the synthetic resin coat 4 on the plate B, which is not protected by toner 6. In this process the difference in solubility to the solvent used, between the toner 6 and its binder resin on the image area, and the synthetic resin of the transfer printing plate permits removing the synthetic resin of non-image area 4', leaving the image area covered by toner 6, and the bare surface of the metal plate in the non-image area. The removal is carried out by dipping in a solvent or by spraying or brushing. An organic solvent is available for this purpose; and they are selectively used depending on the type of the binder resin of the toner and the synthetic resin on the transfer printing plate. Organic solvents to be used in the present invention are available such as hydrocarbon, chlorinated hydrocarbon, alcohols, esters ketones; but on account of toxicity, inflammability, odor, or eflluent disposal, the following are desirably employed singly or as a mixture: lactones such as butyrolactone, propiolactone, valerolatone; cellosolves such as ethylene glycol monomethyl ether, ethylene glycol monoethyl ether, ethylene glycol monoethyl ether acetate; and carbitols such as diethylene glycol monomethyl ether, diethylene glycol monoethyl ether, diethylene glycol monobutyl ether, and if necessary, various surface active agents may be blended to increase the dissolving power.

Figure 6:
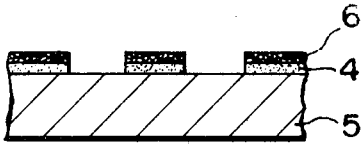
FIG. 6 is an enlarged view in section of the transfer printing plate with non-image synthetic resin layer removed.
Figure 7:
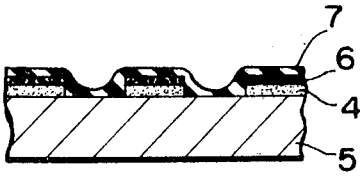
FIG. 7 is an enlarged view in section of the printing plate treated with a gum arabic desensitizer formed thereon for hydrophilic layer.

Next, the transfer printing plate obtained in FIG. 6 is treated with a gum arabic for making a hydrophilic layer just like the conventional lithographic printing plate, to form a non-oleophilic layer 7, thereby yielding a printing plate (FIG. 7).

In this case, as a gum arabic solution is applied to the whole surface of the transfer printing plate, the non-oleophilic layer of gum arabic 7 is formed not only on the surface of metal printing plate 5 which is exposed by development, but also on the toner layer 6, as shown in FIG. 7. This layer of gum arabic on toner layer 6 is, however removed with warm water upon printing process, or when tincture treatment or protection ink application is conducted before non-oleophilic treatment for enhancing the oleophilic property of the toner image, as is carried out in the ordinary offset printing, almost no gum arabic layer remains on the toner layer 6, thereby causing no problem for printing. Ordinary methods usually employed in lithographic printing plate are applied for such non-oleophilic and oleophilic treatments.

Figure 8:
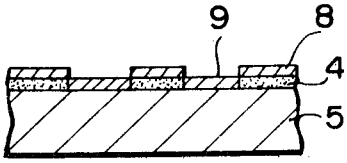
FIG. 8 is an enlarged sectional view of a printing plate with a synthetic resin layer formed thereon by removing the toner layer through dissolution.

The lithographic printing plate obtained by the above process shown in FIG. 1 to FIG. 7 of the present invention may be used as such. Furthermore, a printing plate obtained by removal of toner layer 6 as shown in FIG. 8 may also be used. In this case, after the transfer printing plate shown in FIG. 6 is obtained, and before the hydrophilic treatment, the toner layer 6 can be removed with use of a solvent effective only to dissolve the toner layer 6 but not the synthetic resin layer 4 remaining under the toner, and after hydrophilic treatment with a gum arabic solution in the same manner as mentioned above, an ink 8 can be applied to the synthetic resin layer 4 of the image area (FIG. 8). In FIG. 8, 9 denotes a fountain water.

It is preferable that the transfer printing plate obtained in FIG. 6 is subjected to hydrophilic treatment as shown in FIG. 7, and then treated with a suitable solvent to remove the toner layer 6, or only the toner layer 6 is removed by treating the transfer printing plate obtained by development as shown in FIG. 6 with a hydrophilic treating liquid, for example an aqueous solution of gum arabic in which suitable organic solvent is dispersed. In this case, the organic synthetic resin layer 4 is protected with, for example gam arabic adsorbed on the synthetic resin layer 4 upon hydrophilic treatment, from the solvent using for dissolving the toner layer 6. The synthetic resin layer 4 is, as in case of ordinary lithographic printing plate, non-hydrophilic.

Examples embodying the present invention are cited here for better understanding of the present invention but they are not meant to restrict the present invention.

EXAMPLE 1

A transfer printing plate was prepared as follows:
A solution of the following composition:

| | |
|---|---|
| epoxy resin ("Epikote 1007" of Shell Co.) | 10 parts by weight |
| dyestuff ("Sudan Blue-II" of BASF Co.) | 0.1 part by weight |
| ethylene glycol monoethyl ether | 90 parts by weight |

was coated onto a brush-grained and anodized aluminum plate by a whirler at 100 rpm and having three 300-W infrared lamps, and after 5 minutes of drying, a transfer printing plate with a 2.9$\mu$ thick coat of epoxy resin was obtained.

A commercially available zinc oxide photoconductive sheet was minus-charged by means of a −6,000 V corona charging device of corotoron type. Thereafter an image of an original was projected through a lens system using ten 20-W fluorescent lamps, as a reflected positive image, onto this photosensitive sheet. The electrostatic latent image formed on the sheet was developed by the magnet brush method using a polystyrene group toner. The sheet with the developed toner image was closely contacted with the resin coated side of the transfer printing plate and the toner image was transferred onto the transfer printing plate under a linear pressure of 50 g/cm applied to the plate and a voltage of −800 V impressed by bias roller method. The transfer efficiency of the toner as found from measurement before and after transfer was 94% in terms of toner weight ratio.

The toner image on this transfer printing plate was thermally fixed by the heat radiant method; then a removing solution composed of 95 parts by weight of diethylene glycol monomethyl ether and 5 parts by weight of 85% aqueous solution of phosphoric acid at 25° C. was sprayed on the plate, with brushing, for 30 seconds to wash out the non-image area epoxy resin, and thereafter an aqueous solution of gum arabic was applied to produce an offset printing plate. Using this plate, a large number of excellent reproduction prints were obtained.

EXAMPLE 2

A ball-grained aluminum plate coated with phenoxy resin (PKHH, of Union Carbide Co.) of a thickness of 3μ was used as the resin coated plate. This plate was processed in the same manner as in Example 1 to produce a transfer printing plate, the prints made were of excellent quality and a large number of prints were made from the plate.

EXAMPLE 3

A brush-grained and anodized aluminum plate coated with butyral resin (S-LEC BM-S, of Sekisui Chemical Co., Ltd.) of a thickness of 2μ was used as the transfer printing plate, and was subjected to the same treatment as in Example 1 through the step of removing the non-image area 4' of the resin. Then the toner layer only was removed using trichloroethylene, and then desensitizer gum arabic was applied to the resin forming the image area, thereto preparing an offset printing plate. A large number of prints could be made with good reproducibility from this plate.

EXAMPLE 4

A printing plate was produced in the same way as in Example 1, except that the toner was fixed by exposure to trichloroethylene vapor for one minute; and using this plate, prints were taken with equally good results.

EXAMPLE 5

Using the image exposure device of Example 1 with one mirror in addition to the lens, an original in the form of a newspaper paste-up was exposed; and in the same way as in Example 1 a direct-lithographic printing plate with a highly durable reversed image was obtained.

EXAMPLE 6

A photographic enlarging machine (S-690 Professional DX, of Fuji Photofilm Co.) and a positive microfilm were used to expose the photoconductive sheet. Otherwise the same method as in Example 1 was employed to obtain a transfer printing plate. As the result, an excellent offset printing plate was obtained.

EXAMPLE 7

A newspaper facsimile receiving device with a 100 mW He-Ne laser was used in the process of exposure, a photoconductive sheet preliminarily charged by the same method as in Example 1 was attached to a base plate, and by scanning with the laser beam an electrostatic latent image was formed. Otherwise the same method as in Example 1 was applied. As the result, a highly durable offset printing plate was obtained without making a conventional facsimile negative film.

EXAMPLE 8

On a transfer printing plate obtained by the same procedure as in Example 1 was placed a liquid for removal of toner layer and the toner layer was wiped off by using sponge, cotton or cloth.

Formulation of the toner-removing liquid is as follows:

| | |
|---|---|
| Liquid A: | |
| gum arabic 14° Be | 50 parts by weight |
| triethylene glycol | 5 parts by weight |
| phosphoric acid (85%) | 5 parts by weight |
| AEROSIL 300 (calcined silica made by Japan Aerosil Co., Ltd.) | 3 parts by weight |
| polyethylene glycol nonylphenyl ether (Noigen EA 140, product of Daiichi Kogyo Seiyaku Co., Ltd.) | 8 parts by weight |
| water | 35 parts by weight |
| Liquid B: | |
| cyclohexanone | 50 parts by weight |
| trichloroethane | 40 parts by weight |
| polyethylene glycol nonylphenyl ether (Noigen EA 80) | 8 parts by weight |

Liquid B was gradually dropped with stirring into Liquid A and then dispersed by means of homogenizer to prepare a milky white emulsion.

A transfer printing plate from which toner layer is removed with the above-described toner-removing liquid may be used as a printing plate without any procedure, because the non-image layer thereon is treated by a hydrophilic treatment.

Excellent prints can be obtained by using this printing plate after removing the toner layer 6, because the thickness of the printing plate becomes the thickness of only synthetic resin layer 4. For instance, when an image of 50μ of width is provided on the printing plate and an ink is applied thereto, the ink is attached not only on the surface of the image but also on the both sides. The ink attached to the sides is also transferred upon transfer printing, thereby printing an image of thick line. The thicker the image layer (sides), the thicker the printed line.

When thickness of the synthetic resin layer 4 is 2μ and an image having 50μ of width is provided thereon, a transfer printed image having a width of $50+2\times2=54\mu$ is obtained by this printing plate. As the toner layer 6 is applied in a thickness of 17 to 20μ on the resin layer, a transfer printed image of 90μ width can be obtained by a transfer printing plate with a toner layer having an image of 20μ thickness.

Duration of printing plate from which the toner layer is removed decreases. It is suitable for applying to a transfer printing with beautiful finish of reproduction, but not a large number of reproduction prints. The duration of this transfer printing plate is better than those obtained by direct transfer of the toner image onto a printing metal plate.

TEST EXAMPLE 1

A transfer printing plate A was prepared by coating the solution described in Example 1 onto a brush-grained and anodized aluminum plate to form epoxy resin coat of 1μ of thickness by the same method as in Example 1.

For comparison's sake, a transfer printing plate B was prepared by coating a solution consisting of 100 parts by weight of ethylene glycol monomethyl ether, 5 parts by weight of naphthalene-1,8-dicarboxylic acid (naphthalic acid), and 2 parts by weight of styrene copolymer containing carbonyl group onto a brush-grained and anodized aluminum plate to form a coat of 1μ of thickness.

A toner image was transferred onto each transfer printing plate A and B by bias roll method under application of voltage of −800 V. The non-image areas were removed by using diethylene glycol monomethyl ether in the transfer printing plate A and aqueous solution of sodium metasilicate in the transfer printing plate B by given procedures to produce offset printing plates.

The prints obtained by these transfer printing plates were compared in 50% screen dot area of 65 line inch.

The transfer printing plate A completely transferred without hollow image, whereas the transfer printing plate B showed hollow image in 30% screen dot area.

TEST EXAMPLE 2

In a similar way to Example 1, transfer printing plates were prepared by coating varied thicknesses of epoxy resin (Epikote 1007 of Shell Co.) layer onto a brush-grained and anodized aluminum plate. The toner image was transferred onto said transfer printing plates under a liner pressure of 50 g/cm and varied voltages impressed by bias roller method. After the transfer was effected, the transfer efficiency of the toner as found from measurement before and after transfer was evaluated in terms of toner weight ratio.

Transfer efficiency (%) =

$$\frac{\text{the weight of toner transferred onto the transfer printing plate}}{\text{the weight of toner on the photoconductive sheet before transfer}} \times 100$$

The result is shown on the following table:

TABLE

Transfer efficiency variation due to the film thickness of the resin layer on the transfer printing plate

| | Transfer efficiency (%) B (V) | | | | | | | | |
|---|---|---|---|---|---|---|---|---|---|
| A (μ) | 0 | −100 | −200 | −300 | −400 | −500 | −600 | −700 | −800 |
| 0 | 40 | 65 | 70 | 85 | 87 | 90 | 91 | 92 | 93 |
| 2 | 35 | 60 | 85 | 90 | 94 | 97 | 98 | 98 | 98 |
| 10 | 30 | 50 | 80 | 90 | 93 | 97 | 98 | 98 | 98 |
| 15 | 5 | 14 | 23 | 31 | 40 | 49 | 58 | 66 | 75 |

A: Thickness of resin-layer on the transfer printing plate (μ)
B: Transfer bias voltage Va (V)

As seen from the result of the above Table, the transfer printing plate with 2μ or 10μ of the resin layer thickness exhibits the excellent transfer efficiency of 97–98%. Although nearly 92% of the transfer efficiency can be obtained even if the transfer is effected onto the plate with 0μ of resin layer thickness, i.e., directly onto the aluminum plate, the so-called hollow phenomenon that no toner image is transferred in the center of the transferred toner image takes place and therefore, this plate cannot be practically employed as a printing plate. And it has low printing durability.

In case that the thickness of resin layer is 15μ, the transfer efficiency is very bad because voltage is not impressed on the plate, and only 75% of the toner is transferred even if −800 V is impressed. In case that the resin layer is made thick like this, it is not desirable because the resin below the transferred toner image layer is also dissolved in developing, i.e., in dissolving the non-image resin layer with the solvent. Further, it is not desirable because it takes a long time to dissolve the non-image resin layer when the resin layer is thick.

What is claimed is:

1. A method of making a lithographic printing plate comprising forming a toner image, coating a metal plate with a 0.5 to 10μ thick, electrically insulating, durable synthetic resin layer, transferring the toner image onto the surface of the layer of resin by a bias roll method, fixing the toner image on the resin layer to provide image areas on the surface of the resin to be protected by the toner from a subsequently applied organic solvent, removing the resin from the non-toner protected areas of the plate with said organic solvent, thereafter dissolving the toner without dissolving the remaining resin to leave said resin image areas, and performing a hydrophilic treatment on the non-resin-coated areas of the plate.

2. A method according to claim 1 wherein said step of coating comprises coating the plate with a layer of synthetic resin 1 to 5μ thick.

3. A method according to claim 1 wherein said step of coating comprises, coating said plate with a thin layer of a durable synthetic resin having toner retaining characteristics and being soluble in a solvent in which the fixed toner image is essentially insoluble.

4. A method according to claim 1 wherein said step of coating a plate comprises, coating a metal base plate for lithographic printing, said metal base plate being selected from the group consisting of an aluminum plate, a zinc plate, a bimetal plate, and a trimetal plate.

5. A method according to claim 4 wherein said aluminum plate for lithographic printing is a grained or anodized aluminum plate.

6. A method according to claim 1 wherein said step of forming a toner image comprises forming a toner image from a toner of a particle size less than 10μ.

7. A method according to claim 6 wherein said toner has a particle size of about 5μ.

8. A method according to claim 1 wherein said step of transferring the toner image comprises transferring the toner image onto the surface of the resin coated plate by applying pressure and an electric field.

9. A method according to claim 8 wherein said toner image is transferred to the surface of the resin coated plate under the action of a bias roller.

10. A method according to claim 1 wherein said step of coating comprises, coating said plate with a synthetic resin soluble in an organic solvent or an alkaline aqueous solution.

* * * * *

UNITED STATES PATENT AND TRADEMARK OFFICE

CERTIFICATE OF CORRECTION

PATENT NO. : 4,444,858

DATED : April 24, 1984

INVENTOR(S) : Nishibu et al

It is certified that error appears in the above-identified patent and that said Letters Patent is hereby corrected as shown below:

Cancel Claim 9.

"Claim 10" should be -- Claim 9 --.

On the title page, "10 Claims, 8 Drawing Figures" should read -- 9 Claims, 8 Drawing Figures --.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*